US006161967A

United States Patent [19]

Sugata et al.

[11] Patent Number: 6,161,967

[45] Date of Patent: Dec. 19, 2000

[54] CONVEYING APPARATUS FOR PHOTOGRAPHIC LIGHT-SENSITIVE MATERIALS

[75] Inventors: Yoshihisa Sugata; Kenji Todoki, both of Wakayama, Japan

[73] Assignee: Noritsu Koki Co., Ltd., Wakayama, Japan

[21] Appl. No.: 09/168,992

[22] Filed: Oct. 9, 1998

[30] Foreign Application Priority Data

Oct. 9, 1997 [JP] Japan ..... 9-277828

[51] Int. Cl.[7] ..... G03D 7/00

[52] U.S. Cl. ..... 396/579; 396/612; 396/618; 34/444

[58] Field of Search ..... 396/579, 612, 396/618, 620, 622; 34/444, 464, 500, 559; 355/27

[56] References Cited

U.S. PATENT DOCUMENTS 3,860,944 1/1975 Huber et al. ..... 396/622

FOREIGN PATENT DOCUMENTS

| | | |
|---|---|---|
| 0 798 596 A1 | 10/1997 | European Pat. Off. . |
| 1 019 176 | 11/1957 | Germany . |
| 62-182743 | 8/1987 | Japan . |
| 6-54379 | 7/1994 | Japan . |
| 9-043826 | 2/1997 | Japan . |
| 1 211 916 | 11/1970 | United Kingdom . |

*Primary Examiner*—D. Rutledge

*Attorney, Agent, or Firm*—Wenderoth, Lind & Ponack, L.L.P.

[57] ABSTRACT

A photographic light-sensitive material conveying apparatus for conveying a photographic light-sensitive material in a dryer chamber has a hollow guide member fixedly mounted in the dryer chamber for shifting the conveying direction of the photographic light-sensitive material. An air suction duct is connected to the inner space of the guide member. A plurality of perforations are formed in the guide member for communication between the inner space of the guide member and the interior of the dryer chamber. A conveyor belt has air permeability and is provided over the guide member for conveying the photographic light-sensitive material, wherein the conveyor belt can slidingly run on and along the outer side of the guide member.

8 Claims, 4 Drawing Sheets

CONVEYING APPARATUS FOR PHOTOGRAPHIC LIGHT-SENSITIVE MATERIALS

BACKGROUND OF THE INVENTION

The present invention relates to a conveying apparatus for conveying a photographic light-sensitive material in a dryer chamber of an automatic photographic developer machine.

In a common automatic developer machine, a tape of photographic light-sensitive material is subjected to a series of developing, fixing, and rinsing processes, where it is immersed in different processing fluids including a developer, a fixer, and other solutions which are contained in their respective tanks, before being transferred into a dryer chamber. The photographic light-sensitive material is then dried out as it is conveyed through the drier chamber. For increasing the during efficiency of the photographic light-sensitive material in a limited path in the dryer chamber, it is desired to turn back the photographic light-sensitive material at the other end of the path in the dryer chamber so that it can run forward and backward in the dryer chamber.

As disclosed, for example, in Japanese Patent Publication No. Hei 6-54379, a conveying apparatus, which comprises guide rollers of a cylindrical shape having a plurality of suction holes and arranged to be movable, a net-like conveyor belt mounted for running on the guide rollers to convey the photographic light-sensitive material, and a duct communicating between the inner space of the guide rollers and the suction inlet of an air blower, is provided in the dryer chamber. The air blower, when driven, draws air via the duct from the inner space of the guide rollers. Its suction action causes the photographic light-sensitive material to be attached to the outer side of the guide rollers while being conveyed on the conveyor belt. Hence, the movement of the photographic light-sensitive material along the outer side of the guide rollers can be smoothly shifted to another direction.

However, in the construction of the conventional apparatus the guide rollers have to be rotated in relation to duct, and the sealing at the joint between the duct and the guide rollers is made difficult. If the sealing between the duct and the guide rollers is inadequate, the suction capability is reduced and may prevent the photographic light-sensitive material from smoothly shifting its moving direction along the guide rollers.

SUMMARY OF THE INVENTION

The present invention has been developed in view of the above, and its object is to provide a photographic light-sensitive material conveying apparatus which facilitates sealing at a joint between a turning member for the photographic light-sensitive material and a duct while smoothly shifting the moving direction of the photographic light-sensitive material.

For achievement of the object of the present invention, a photographic light-sensitive material conveying apparatus for conveying a photographic light-sensitive material B in a dryer chamber 20 is characterized by a hollow guide member 6 fixedly mounted in the dryer chamber 20 for shifting the conveying direction of the photographic light-sensitive material B. An air suction duct 7, connected to inner space 63 of the guide member 6, the guide member 6 having a plurality of perforations 64 for communication between the inner space 63 of the guide member 6 and the interior of the dryer chamber 20. A conveyor belt 5 has air permeability and is provided over the guide member 6 for conveying the photographic light-sensitive material B, wherein the conveyor belt B can slidingly run on and along the outer side of the guide member 6.

In addition, the guide member 6 is finished with a surface coating for increasing the slidability of the conveyor belt 5, whereby the conveyor belt 5 can slidingly move on the guide member 6.

Moreover, an air blowing means 9 is provided outside the guide member 6 for directing air to the guide member 6, whereby the photographic light-sensitive material B can be closely attached to the outer side of the guide member 6 while being conveyed along the guide member 6.

DETAILED DESCRIPTION OF THE PREFERRED EMBODIMENT

The present invention will be described referring to the accompanying drawings.

Figure 5:
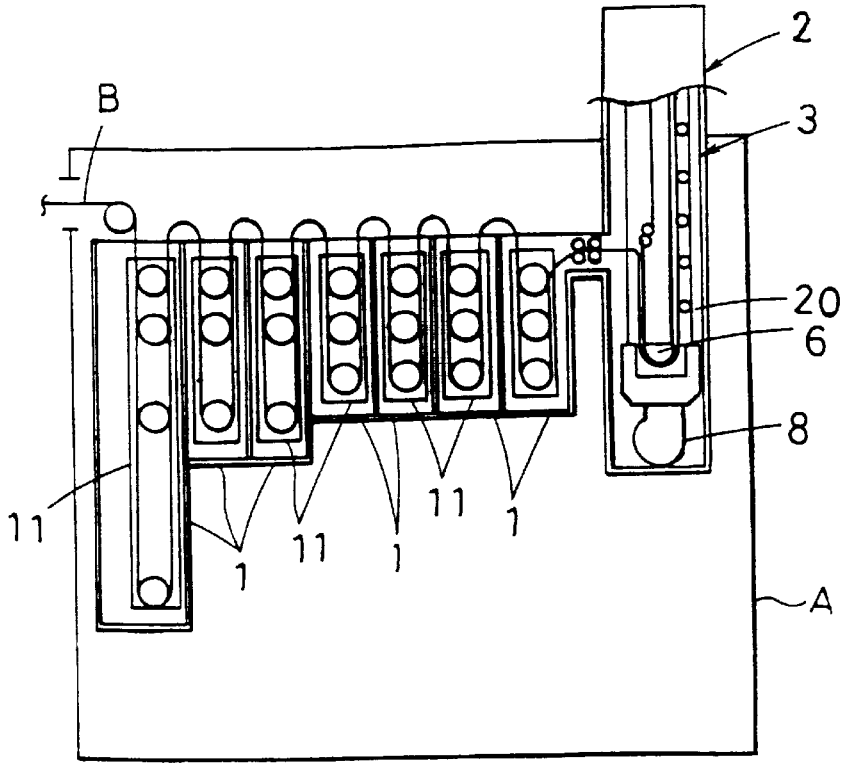
FIG. 5 is a schematic explanatory view of an automatic developer machine to which the present invention is applied.

FIG. 5 schematically illustrates an automatic developer machine to which the present invention is applied. A case A of the developer machine contains a plurality of processing tanks 1 and a dryer housing 2 arranged in a row. The processing tanks 1 are filled with a fixer, a stabilizer, and other processing solutions, respectively. While a series of conveying apparatuses 11 are provided in the processing tanks 1 for conveying a photographic light-sensitive material B through the processing solutions as immersed in the solutions, a conveying apparatus 3 for conveying the photographic light-sensitive material B throughout a dryer chamber 20 of the dryer housing 2 is provided in the dryer chamber 20.

In the automatic developer machine, the photographic light-sensitive material B such as a photographic paper is immersed in the processing solutions, including the developer and the fixer, in the processing tanks 1 for sequential development, fixing, and rinsing processes, and is then transferred into the dryer chamber 20 of the dryer housing 2. It is then first conveyed towards the bottom of the dryer chamber 20 by the conveying apparatus 3, and then shifts its moving direction or is U-turned at the bottom of the dryer chamber 20 before returning back towards the upper end of the dryer chamber 20, so that the sensitive material B can be dried out by dried air blown into the dryer chamber 20.

The present invention resides in the conveying apparatus 3 provided in the dryer chamber 20 of the automatic developer machine. The conveying apparatus 3 is now described in more detail, referring to the illustrated preferred embodiment.

The conveying apparatus 3 substantially comprises an elongated rack 4 mounted in the dryer chamber 20 of the dryer housing 2, and an endless conveyor belt 5 having air permeability located between two, left and right, side plates 41 and 42 of the rack 4. The belt 5 is driven by a plurality of drive pulleys 50 rotated by a drive mechanism (not shown) for upward and downward circular movement along a guide member 6, described later. Also, a plurality of guide rollers 43, which directly touch the conveyor belt 5, are rotatably mounted between the two side plates 41 and 42 so that the photographic light-sensitive material B conveyed on the conveyor belt 5 are guided by the guide rollers 43.

The conveyor belt 5 shown is made of a net form where the weft is 0.2 mm in thickness and the warp is 0.8 mm in thickness, having an aperture rate of about 40 percent. The weft and warp threads of the conveyor belt 5 may preferably be polyester resin, which has a higher thermal resistance.

Figure 3:
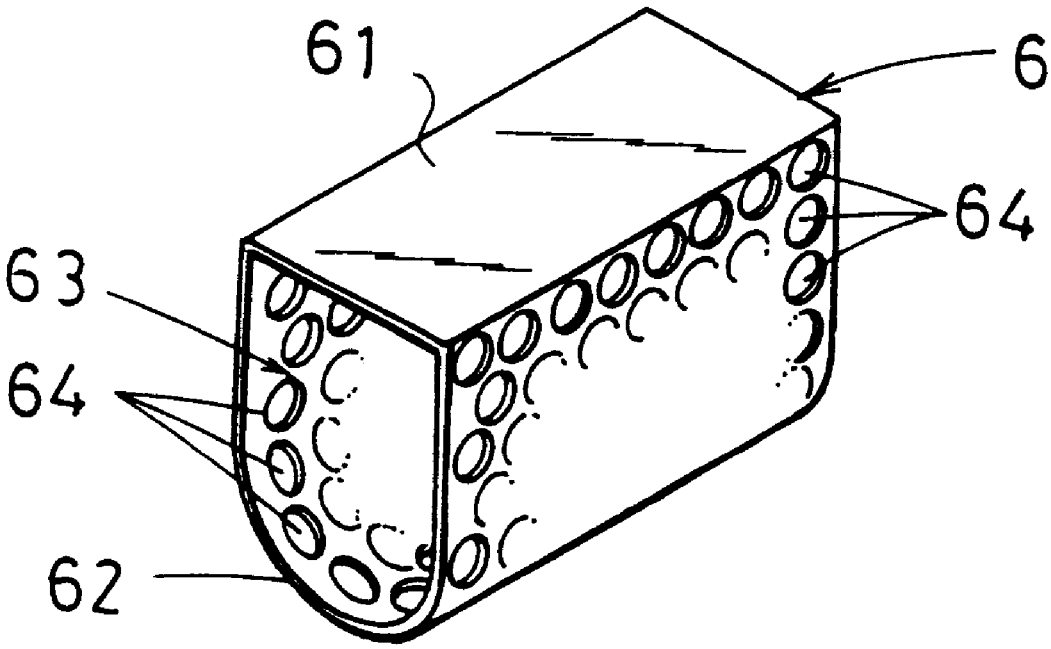
FIG. 3 is a schematic perspective view of a guide body.

The guide member 6 is made of a metal sheet, as shown in FIG. 3, which has a tubular shape consisting of an upper wall 61 and a substantially U-shaped arcuate wall 62 extending downwardly from both ends of the upper wall 61. The arcuate wall 62 has a multiplicity of circular perforations 64 provided therein for fluid communication between the inner space 63 of the guide member 6 and the outside of the arcuate wall 62.

The guide member 6, sandwiched between the left and right side plates 41 and 42 of the rack 4, is fixedly joined with its left and right open ends to the two side plates 41 and 42, respectively, and allows the conveyor belt 5 to run on and along the outer side of the arcuate wall 62 so that the moving direction of the conveyor belt 5, and the photographic light-sensitive material B conveyed on the conveyor belt 5, can be shifted from downward to upward.

In the illustrated embodiment, the outer side of the arcuate wall 62 is covered with a coating of fluoroplastic resin or the like for promoting the sliding movement of the conveyor belt 5 on the arcuate wall 62.

For promoting the sliding movement of the conveyor belt 5 on the arcuate wall 62, it is also possible to have the arcuate wall 62 made of a highly slidable material or polished at its outer side to a mirror surface. The conveyor belt 5 may also be made of a highly slidable material or covered with a coating of fluoroplastic resin or the like to increase its slidability over the arcuate wall 62.

Figure 1:
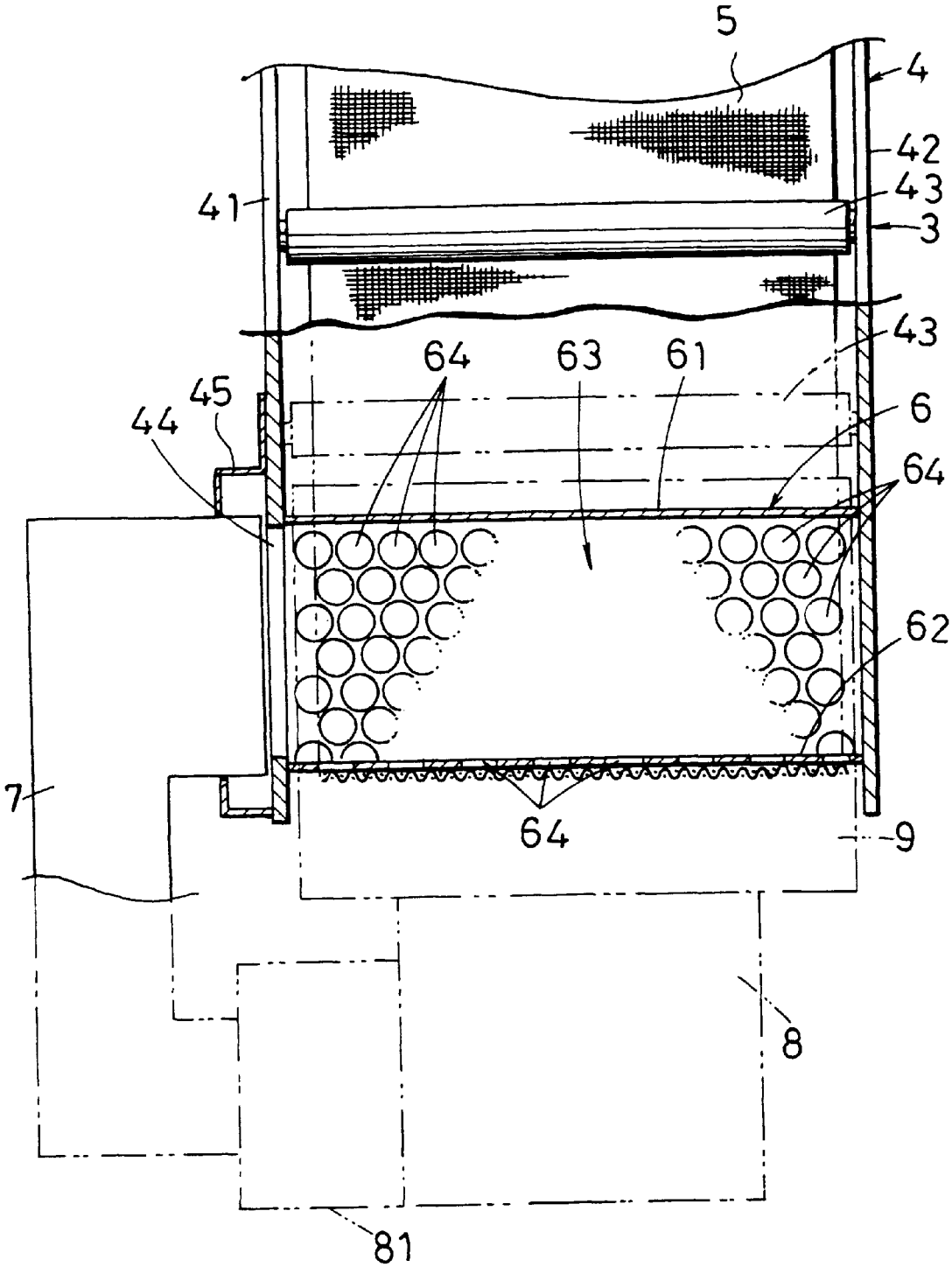
FIG. 1 is a schematic front view showing a partially cutoff primary section of a conveying apparatus according to the present invention.
Figure 2:
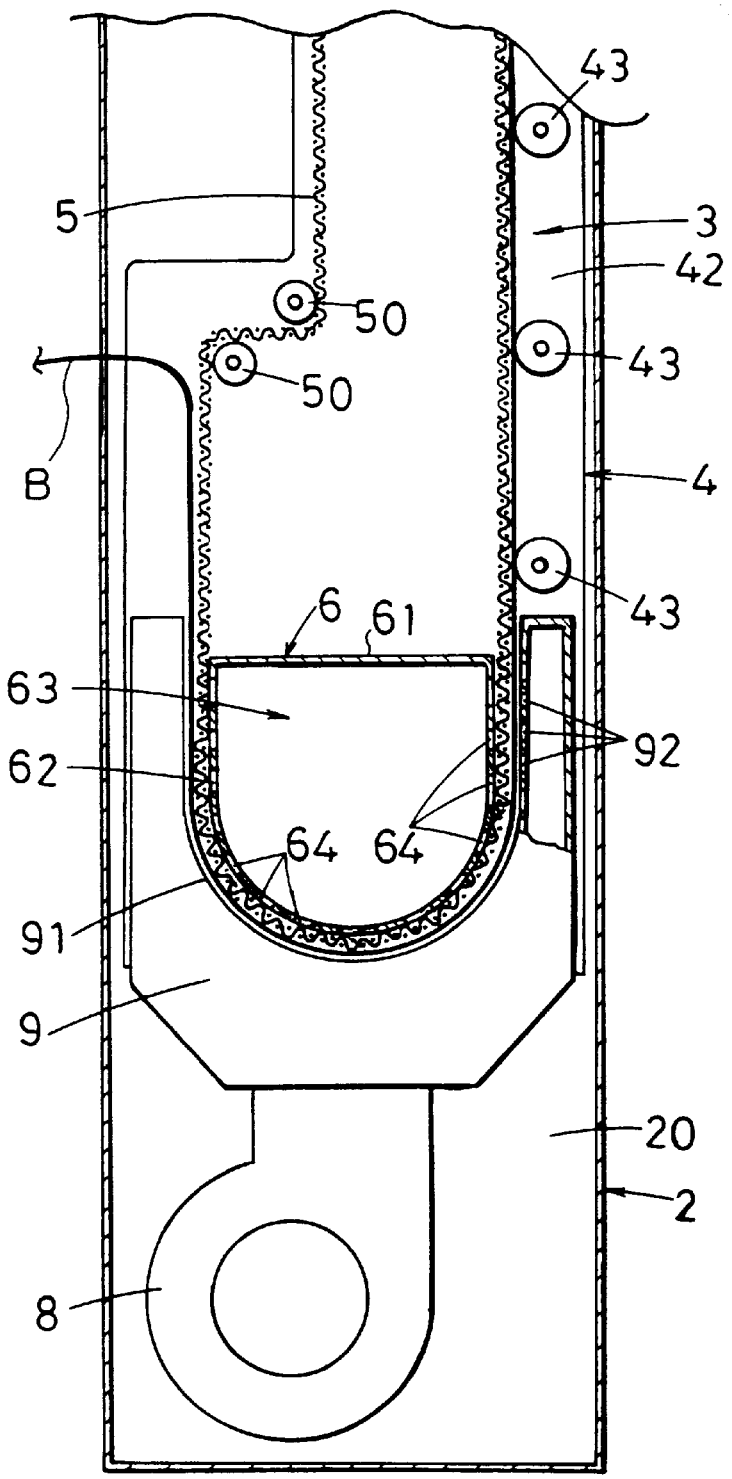
FIG. 2 is a schematic side view of the partially cutoff primary section of the conveying apparatus installed in a dryer chamber.

One of the left and right side plates 41 and 42, the left side plate 41 in this embodiment as shown in FIG. 1, has a through hole 44 provided therein for communicating the inner space 63 of the guide member 6 and a joint bracket 45 mounted to the outer side thereof to cover a rim of the through hole 44. A suction duct 7, which has separately been formed, is joined at one lengthwise end to the joint bracket 45.

An air blower 8 is mounted beneath the rack 4 in the dryer chamber 20 and is joined at its suction opening side to the other end of the suction duct 7 so that when the air blower 8 is driven, it draws air via the suction duct 7 from the inner space 63 of the guide member 6 and the outside of the arcuate wall 62.

Figure 4:
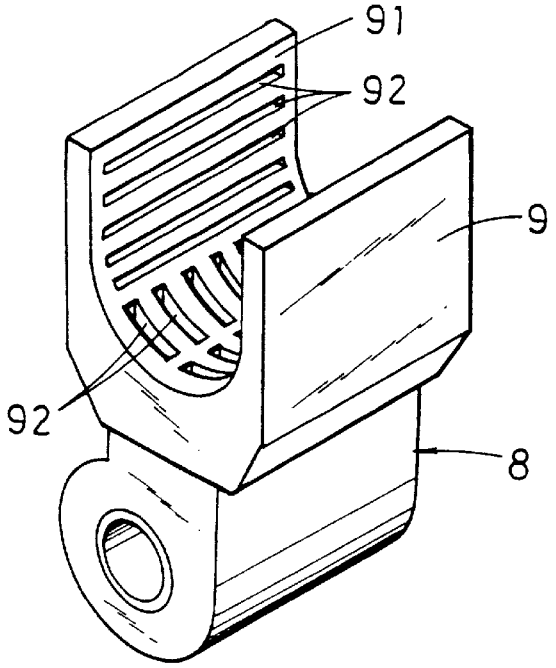
FIG. 4 is a schematic perspective view of a blowout duct mounted to a blower.

In this embodiment, an air blowing duct 9, which is formed of substantially a horse-shoe shape, having an arcuate slotted wall 91 thereof spaced by a predetermined distance from the outer side of the arcuate wall 62 of the guide member 6, is mounted on the air blowing side of the air blower 8 as shown in FIG. 4. A flow of air from the air blower 8 can thus be directed to the outer side of the arcuate wall 62 through a number of slits 92 provided in the slotted wall 91.

As shown, denoted by 81 is a heater mounted to the suction opening side of the air blower 8.

The operation of the conveying apparatus having the above arrangement is now explained.

The photographic light-sensitive material B which has been developed in the processing tank 1 of the automatic developer machine and transferred into the dryer chamber 20 is conveyed on the conveyor belt 5 to the downward end of the dryer chamber 20, turned along the arcuate wall 62 of the guide member 6, and moved back upwardly which being dried in the dryer chamber 20.

The driving of the air blower 8 draws the air from the inner space 63 of the guide member 6 via the suction duct 7 and from the outside of the arcuate wall 64 via the perforations 62. Simultaneously, a flow of air from the air blower 8 is delivered via the slits 92 provided in the slotted wall 91 of the air blowing duct 9 to the conveyor belt 5, which is directly running on the outer side of the arcuate wall 62. Accordingly, the photographic light-sensitive material B conveyed on the conveyor belt 5 can smoothly be turned in the opposite direction which moving closely along the outer side of the arcuate wall 62, separated by the conveyor belt 5.

As set forth above, the guide member 6 and the suction duct 7, communicating with the inner space 63 of the guide member 6 in the embodiment, are mounted stationary, and a sealing arrangement between the guide member 6 and the suction duct 7 will be simple in structure, thus reducing the production cost and facilitating the assembly work.

In the embodiment, although the flow of air from the air blower 8 is directed via the blowing duct 9 to the outer side of the arcuate wall 62, this is not a limitation.

Also, the shape of the perforations 64 is not limited to a circular shape, and a square or a slit-like shape may be used.

The guide member 6 may be of a molded resin form.

What is claimed is:

1. A photographic light-sensitive material conveying apparatus for conveying a photographic light-sensitive material in a dryer chamber, comprising:

a hollow tubular guide member fixedly mounted in the dryer chamber for shifting a conveying direction of the photographic light-sensitive material, said tubular guide member having an outer side and an inner space;

an air suction duct connected to said inner space of said tubular guide member;

a plurality of perforations in said tubular guide member communicating between said inner space of said tubular guide member and the interior of the dryer chamber; and an air permeable conveyor belt provided over said tubular guide member for conveying the photographic light sensitive material, wherein said conveyor belt can slide on and along said outer side of said tubular guide member.

2. The apparatus of claim 1, wherein said outer side of said tubular guide member has a surface coating for increasing the slidability of said conveyor belt.

3. The apparatus of claim 2, wherein an air blower is provided outside of said tubular guide member for directing air to said tubular guide member.

4. The apparatus of claim 1, wherein an air blower is provided outside of said tubular guide member for directing air to said tubular guide member.

5. The apparatus of claim 1, wherein said tubular guide member comprises a U-shaped arcuate wall and said conveyor belt contacts said U-shaped arcuate wall such that conveyor belt forms a U-turn around said tubular guide member.

6. The apparatus of claim 5, wherein said plurality of perforations are formed in said U-shaped arcuate wall.

7. The apparatus of claim 1, wherein said tubular guide member has an opening at a lengthwise end thereof connected to said air suction duct.

8. A photographic light-sensitive material conveying apparatus for conveying a photographic light-sensitive material in a dryer chamber, comprising:

a hollow guide member fixedly mounted in the dryer chamber for shifting a conveying direction of the photographic light-sensitive material, said guide member having a U-shaped arcuate wall with an outer side and an inner space;

an air suction duct connected to said inner space of said guide member;

a plurality of perforations in said guide member communicating between said inner space of said guide member and the interior of the dryer chamber; and an air permeable conveyor belt provided over said guide member for conveying the photographic light sensitive material, wherein said conveyor belt can slide on and along said outer side of said guide member, and wherein said conveyor belt contacts said U-shaped arcuate wall such that conveyor belt forms a U-turn around said guide member.

* * * * *